US012409362B1

(12) United States Patent
Pacholek et al.

(10) Patent No.: US 12,409,362 B1
(45) **Date of Patent: *Sep. 9, 2025**

(54) IMPACT BOARD AND ATHLETIC PERFORMANCE FEEDBACK SYSTEM

(71) Applicant: KING FAHD UNIVERSITY OF PETROLEUM AND MINERALS, Dhahran (SA)

(72) Inventors: Martin Pacholek, Dhahran (SA); Khaled Saleh Al-Athel, Dhahran (SA); Ammar Alzaydi, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 19/209,531

(22) Filed: May 15, 2025

Related U.S. Application Data

(63) Continuation of application No. 17/881,275, filed on Aug. 4, 2022, now Pat. No. 12,318,660.

(51) Int. Cl.
*A63B 24/00* (2006.01)
*A63B 63/00* (2006.01)

(52) U.S. Cl.
CPC ..... *A63B 24/0021* (2013.01); *A63B 63/00* (2013.01); *A63B 2024/0043* (2013.01); *A63B 2220/10* (2013.01); *A63B 2220/40* (2013.01); *A63B 2220/53* (2013.01)

(58) Field of Classification Search
None
See application file for complete search history.

(56) References Cited

U.S. PATENT DOCUMENTS

| | | | | |
|---|---|---|---|---|
| 4,770,527 A | | 9/1988 | Park | |
| 5,230,505 A | * | 7/1993 | Paquet | A63B 69/0002 250/222.2 |
| 5,509,649 A | * | 4/1996 | Buhrkuhl | A63B 69/0002 473/455 |
| 6,575,851 B1 | * | 6/2003 | Lamberti | A63B 24/0084 273/395 |

(Continued)

FOREIGN PATENT DOCUMENTS

GB 2464759 A 5/2010

OTHER PUBLICATIONS

Baca, et al.; Rapid Feedback Systems for Elite Sports Training; Sports Technologies; Pervasive Computing; Oct.-Dec. 2016 ; 7 Pages.

*Primary Examiner* — Sunit Pandya
(74) *Attorney, Agent, or Firm* — Oblon, McClelland, Maier &Neustadt, L.L.P.

(57) ABSTRACT

The system has a non-rebound substrate and a first frame disposed around a peripheral edge thereof. The system further has an array of sensors, a digital sensor interface, and a control unit. The array of sensors is disposed in a center portion of the first frame. The array of sensors has at least 9 accelerometers configured in rows in a rectangular array in the central portion of the first frame. The control unit has a processor electrically connected to the digital sensor interface to receive data from the array of sensors, and has instructions to calculate a force, an impact point, and a distance from a user to the system based on the data received from the array of sensors.

13 Claims, 10 Drawing Sheets

(56) References Cited

U.S. PATENT DOCUMENTS

| | | | | |
|---|---|---|---|---|
| 9,498,679 | B2 * | 11/2016 | Homsi | G09B 19/0038 |
| 11,352,079 | B1 * | 6/2022 | Cash | B60P 3/025 |
| 2005/0187036 | A1 * | 8/2005 | Ziola | A63B 63/00 473/372 |
| 2014/0080638 | A1 * | 3/2014 | Feng | A63B 24/0006 473/439 |
| 2014/0179385 | A1 * | 6/2014 | Homsi | A63C 19/02 463/7 |

* cited by examiner

IMPACT BOARD AND ATHLETIC PERFORMANCE FEEDBACK SYSTEM

CROSS-REFERENCE TO RELATED APPLICATIONS

The present application is a Continuation of U.S. application Ser. No. 17/881,275, now allowed, having a filing date of Aug. 4, 2022.

BACKGROUND

Technical Field

The present disclosure is directed to impact detection and sensing; and more particularly to an athlete performance feedback system and method to measure performance of athletes in different ball sports.

Description of Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Physical attributes of the human body can be improved by training. One of the most important physical attributes, especially for athletes, is stamina. Essentially all sports and games require stamina in one form or the other. This may be especially true for ball sports where athletes may be required to throw and/or hit a ball with force multiple times, consistently and regularly, during play. Therefore, athletes are always trying to improve stamina through training. However, it may not always be feasible for an athlete to quantify how much improvement has occurred with training after a certain amount of time. There is a need for a device or system that may help athletes to measure different outcomes of throwing/hitting a ball, including power, speed, force, impulse, accuracy, contact, and reaction time. With this variety of information about the actual physical performance, athletes may be able to benefit from feedback to improve their consistency, accuracy, and satisfaction with the game.

Electronic aids for providing feedback to athletes have become increasingly popular. In sporting events, such as baseball, tennis, golf, where a ball is struck with a bat, racket club, or similar instrument, the force of the impact determines how far and/or fast a ball travels. For such sports, multiple sensors are installed in and/or on the said respective instruments when being used for training, which may provide feedback on impact, force, location, and direction of travel of the ball. However, for other ball sports like softball, handball, volleyball, or even for a pitcher in the baseball, where an instrument available for installation of a sensor may not be applicable, and attaching any sensors directly to the athletes may not be feasible (as it may restrict the athletes' motions), it may not be possible to implement the described method for providing feedback to the athletes.

US Patent Publication No. 20140080638A1 discloses a method and a system for providing training to a kicker in real time, by collecting data while the kicker kicks a ball toward a display screen and determining the trajectory of the ball from the collected data, wherein collecting data comprises a recorded start time at which the ball first begins to move and an end time at which the ball hits the display screen, and wherein the end time is detected by a force sensor array that is positioned behind the display screen.

US Patent Publication No. 20050187036A1 discloses a sport equipment apparatus comprising one or more impact detection sensors operably mounted on or proximal to an impact surface, or an impact surface frame that supports the impact surface, for detecting sports object impact location detection and object velocity.

US Patent Publication No. 20140179385A1 relates to systems and methods for conducting sport-specific activities, using sensor data to evaluate a user's performance and determine sport-specific fitness parameters; and includes structures with an output device, a sensor, and a vertically-arranged planar surface to form a wall; with several such structures being configured to form a boundary which may be automatically adjustable, for example, depending on one or more specific fitness routines to be implemented; and with calculated fitness parameters being visually mapped on the structures of the system.

GB Patent Publication No. 2464759A discloses an apparatus for detecting a position of impact of an object on a target, using a flexible target member with an attached movement sensor adapted to provide signals representative of components of movement of said sensor along two transverse axes, and a data processing system configured to generate data representative of the position of impact of the object.

Non-Patent reference titled "Rapid Feedback Systems for Elite Sports Training" discusses several feedback systems for rowing, table tennis, and the biathlon utilizing different types and arrangements of sensors and other equipment; and, for instance, for table tennis detects an impact of the ball during a short table tennis serve.

Each of the aforementioned references suffers from one or more drawbacks hindering their adoption, including at least some of the shortcomings of the performance feedback system as described above. For example, none of the aforementioned references provides an athlete performance feedback system is singlehandedly suitable for different types of ball sports and be able to detect force of ball impact from a user and impact point of the ball impact.

Accordingly, it is an object of the present disclosure to provide a system for providing performance feedback to users, especially athletes of ball sports, including the force of the ball impact from the user, the impact point of the ball impact, and the distance of the ball impact.

SUMMARY

In an exemplary embodiment, an athlete performance feedback system for ball sports is provided. The system comprises a non-rebound substrate having a length and a height of from 100 cm to 500 cm and a thickness of from 5 mm to 50 mm. The system also comprises a first frame. The first frame is disposed around a peripheral edge of the non-rebound substrate. The system further comprises an array of sensors, a digital sensor interface, and a control unit. The first frame comprises a plurality of supports, with a support of the plurality of supports disposed at each edge of the first frame. The array of sensors is disposed in a center portion of the first frame. The plurality of supports includes two vertical supports with a thickness of from 20 mm to 40 mm and two horizontal supports with a thickness of from 10 mm to 30 mm. The array of sensors are accelerometers. The control unit comprises a processor and the processor is electrically connected to the digital sensor interface. The processor is configured with instructions to calculate a force, an impact point, and a distance from a user to the system based on the data received from the array of sensors. The array of sensors comprises at least 9 accelerometers configured in rows in a rectangular array in the central portion of the first frame. A center sensor of the array of sensors is an aim point for the user, wherein other sensors in the array of sensors detect the force of a ball impact from the user, the impact point of the ball impact, and the distance of the ball impact with respect to the center sensor.

In one or more exemplary embodiments, the non-rebound substrate is substantially rectangular. Further, the first frame is substantially rectangular and is continuous around a circumferential edge of the non-rebound substrate.

In one or more exemplary embodiments, the control unit is an Arduino unit.

In one or more exemplary embodiments, the accelerometers are spaced at most 10 cm apart from each other in the center portion of the first frame. Further, the accelerometers are at least 50 cm away from each edge of the first frame.

In one or more exemplary embodiments, the digital sensor interface comprises a USB or UART.

In one or more exemplary embodiments, the system further comprises a wireless transmission unit electrically connected to the control unit and configured to send data based on the ball impact to the user through a handheld electronic device.

In one or more exemplary embodiments, the non-rebound substrate has a rubber coating.

In one or more exemplary embodiments, the vertical supports are made of wood. Further, the horizontal supports are made of wood.

In one or more exemplary embodiments, the processor is configured with instructions to calculate acceleration, force, time, or impulse of the ball impact.

In one or more exemplary embodiments, each sensor of the array of sensors is a force resistor sensor.

In one or more exemplary embodiments, each sensor of the array of sensors is a piezo resistance accelerometer.

In one or more exemplary embodiments, each sensor of the array of sensors is a capacitive accelerometer.

In one or more exemplary embodiments, the first frame is made of wood.

The foregoing general description of the illustrative embodiments and the following detailed description thereof are merely exemplary aspects of the teachings of this disclosure, and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1:
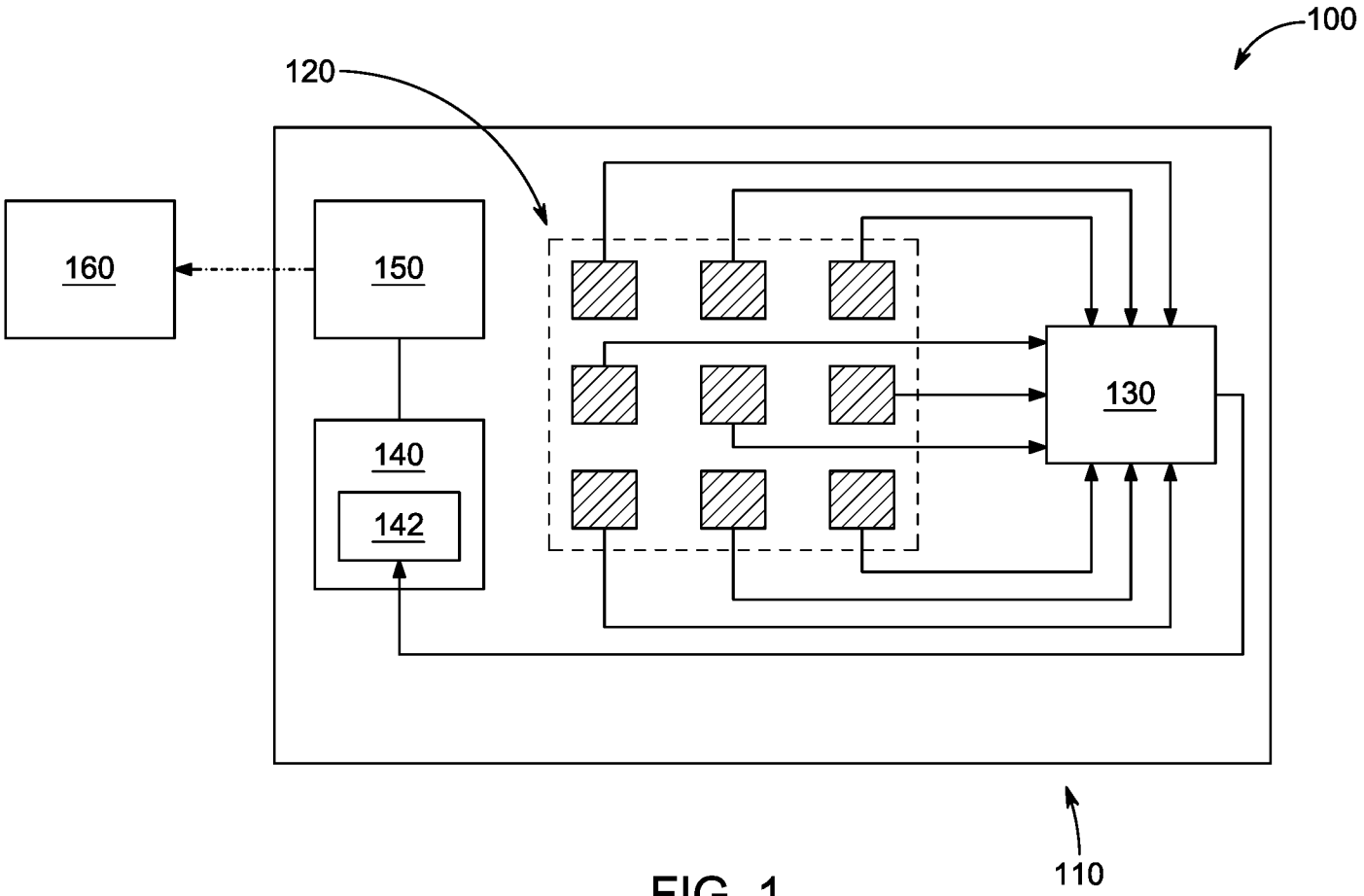
FIG. 1 is a schematic illustration of an athlete performance feedback system, according to certain embodiments.

In the drawings, like reference numerals designate identical or corresponding parts throughout the several views. Further, as used herein, the words "a," "an" and the like generally carry a meaning of "one or more," unless stated otherwise.

Furthermore, the terms "approximately," "approximate," "about," and similar terms generally refer to ranges that include the identified value within a margin of 20%, 10%, or preferably 5%, and any values therebetween.

Aspects of this disclosure are directed to an athlete performance feedback system for ball sports which provides an athlete with information about his/her stamina and/or other performance criteria or training outcomes. The athlete performance feedback system is configured to measure performance of the athlete through data collected from an array of sensors provided on a non-rebound substrate. Data is collected from the sensors for each instance of the non-rebound substrate being hit with a ball directed by the athlete. Further, the data is processed to calculate, for each instance, a force of a ball impact from the athlete, an impact point of the ball impact, and a distance of the ball impact on the non-rebound substrate. Each time the athlete performs tests using the system, the athlete can see the change in performance compared to previously conducted tests. Such calculated parameters may enable the athlete to see if there is an improvement or not, and by how much was the improvement, such as after multiple hits if the force value decreased by a certain percentage, the system may classify it as a drop in the stamina and tell the athlete to, for example, stop for a rest. The athlete performance feedback system is designed to be used in sports industry where it could prove useful to measure stamina of a user, such as in baseball, tennis, table tennis, golf, softball, soccer, and similar sports.

Referring to FIG. 1, illustrated is a schematic illustration of an athlete performance feedback system (referred by reference numeral 100), hereinafter sometimes simply referred to as "system 100", in accordance with certain embodiments of the present disclosure. The present disclosure has been described in terms of the system 100 being designed to be implemented for ball sports, such as, but not limited to, baseball, tennis, table tennis, golf, softball, soccer, medicine ball, kickball, bocce, cricket, squash, volleyball, and the like. In particular, the system 100 is implemented to allow a user, generally an athlete (with the two terms being interchangeably used hereinafter), to undergo training/testing to measure his/her performance parameters (such as, but not limited to, stamina, motor skills, training level, and injury risk) by throwing/hitting ball towards the system 100. The system 100 is configured to detect an impact the ball and calculate a force, an impact point, and a distance from the user to the system 100 due to the impact of the hitting of the ball. Although the present disclosure has been described for ball sports, it will be appreciated that the system 100 may also be directly implemented or configured to be implemented for other sports, including contact sports like boxing, kick boxing, football, hockey, lacrosse, water polo, rugby, and the like without departing from the spirit and the scope of the present disclosure.

As illustrated in FIG. 1, the system 100 includes a non-rebound substrate (as represented by reference numeral 110). The non-rebound substrate 110 is designed to support various components as required for functioning of the system 100. Referring to FIGS. 2-5, illustrated are multiple views of the non-rebound substrate 110 providing details about its structure, shape, and dimensions. As shown in FIGS. 2-5, the non-rebound substrate 110 includes a non-rebound substrate 200. The said substrate 200 is subjected to be hit by the ball each time the user is undergoing the training using the present system 100 to measure his/her performance parameters. As will be discussed later in the description, an impact of hitting of the ball onto the said substrate 200 is measured by using sensors mounted thereon, thus it would be desirable that the said substrate 200 has minimum or preferably no rebound due to hitting of the ball thereat which may otherwise adversely affect ability of the said sensors for accurate measurements (due to their own movements with the rebound effect). The minimization of force/rebound when the ball hits the substrate is what defines the non-rebound nature of the substrate. Non-limiting examples of materials used for the substrate include glass-reinforced plastic, rubber, fiberglass, low density foam, ABS plastic, or a combination of the like. In an alternative embodiment, the substrate may include a plurality of panels to further minimize the impact of the ball impact. In an alternative embodiment, the substrate is reinforced with sand, powder, or other granular materials to further fortify the system and deaden the sound of the ball strike. Therefore, for purposes of the present system 100, the non-rebound substrate 110 utilizes the non-rebound substrate 200 (as described in proceeding paragraphs in detail) to minimize or prevent the rebound effect.

Figure 2:
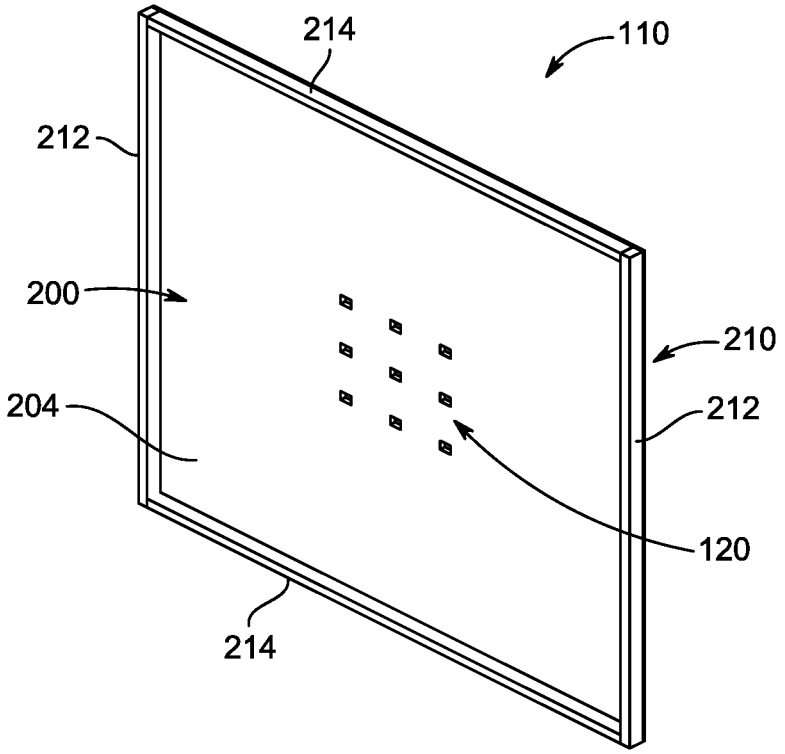
FIG. 2 is a front perspective view illustration of a non-rebound substrate of the athlete performance feedback system, according to certain embodiments.
Figure 3:
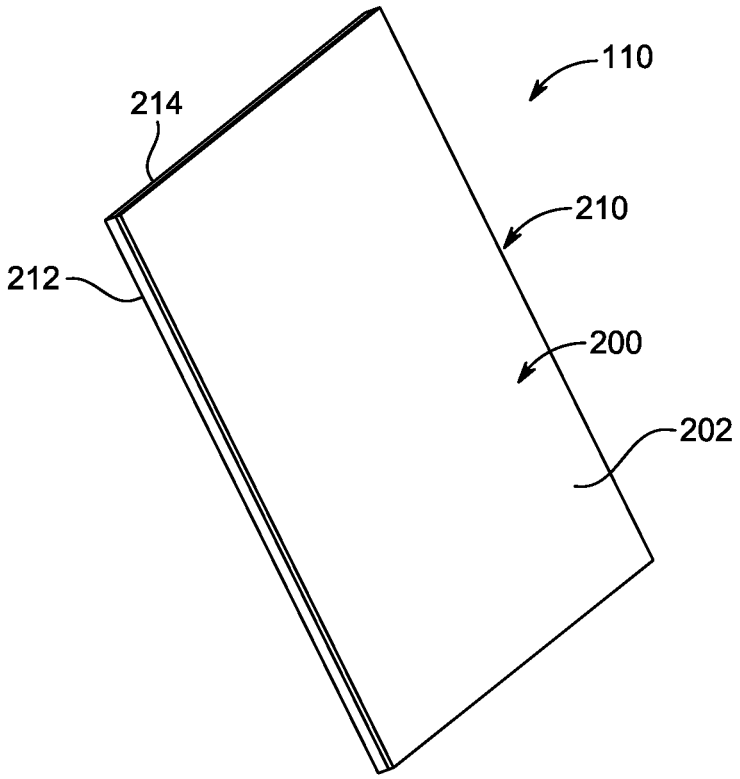
FIG. 3 is a rear perspective view illustration of the non-rebound substrate of the athlete performance feedback system, according to certain embodiments.

In an embodiment, the non-rebound substrate 200 is formed of wood, in particular a wooden panel (as seen in FIG. 3 and represented by reference numeral 202). In alternate examples, the non-rebound substrate 200 may be made of aluminum, like an aluminum sheet without any limitations. Further, the non-rebound substrate 200 has a rubber coating (as seen in FIG. 2 and represented by reference numeral 204). In certain embodiments, the non-rebound rubber coating is made of neoprene, foam rubber, plastics, or the like. In alternate examples, the non-rebound substrate 200 may be coated with leather or other similar materials instead of the rubber coating 204 without any limitations. Herein, the rubber coating 204 may enable the non-rebound substrate 200 to achieve desired minimum or no rebound effect due to impact of hitting of the ball thereat. In particular, as may be seen from combination of FIGS. 2 and 3, the wooden panel 202 forms a back surface of the non-rebound substrate 200 and the rubber coating 204 may form a front surface of the non-rebound substrate 200. Such arrangement is utilized to enable the rubber coating 204 to dampen the impact of the hitting of the ball on the front surface of the non-rebound substrate 200. In certain embodiments, the material for the non-rebound substrate has a Young's modulus, measuring the elasticity and stretching/deforming potential of the material, from 1000 kPa to 50,000 kPa, preferably 5000 kPa to 45,000 kPa, preferably 10,000 kPa to 40,000 kPa, preferably 15000 kPa to 35,000 kPa, preferably 20000 kPa to 30,000 kPa, or 25,000 kPa. It may be appreciated by a person skilled in the art that, in other examples, vibration dampers or the like may alternatively be used instead of the rubber coating 204 on the non-rebound substrate 200 to achieve the same purpose without any limitations.

In an embodiment, the non-rebound substrate 200 has a thickness (as represented by 'T' in FIG. 4) of from 5 mm to 50 mm, preferably 7.5 mm to 47.5 mm, preferably 10 mm to 45 mm, preferably 12.5 mm to 42.5 mm, preferably 15 mm to 40 mm, preferably 17.5 mm to 37.5 mm, preferably 20 mm to 35 mm, preferably 22.5 mm to 32.5 mm, preferably 25 mm to 30 mm, or 27.5 mm. Herein, the said wooden panel 202 may be about half of the given thickness 'T' (i.e., about 2.5 mm to 25 mm) of the non-rebound substrate 200 to provide a sturdy base, and the other half of the given thickness 'T," 2.5 mm to 25 mm, preferably 5 mm to 25 mm, preferably 7.5 mm to 22.5 mm, preferably 10 mm to 20 mm, preferably 12.5 mm to 17.5 mm, or 15 mm, which may constitute the rubber coating 204 of the non-rebound substrate 200 to provide the dampening (no-rebound) effect. In a particular example, the non-rebound substrate 200 may have thickness 'T' of about 4 mm, preferably of 5 mm, preferably of 6 mm, preferably of 7.5 mm, or 10 mm for applications where ball hitting force may not be large, like medical training applications, to save material cost.

Further, as shown, in the present embodiments, the non-rebound substrate 200 is substantially rectangular. Such rectangular shape may be chosen for the non-rebound substrate 200 as it may be suitable for present training purposes by providing the user with a large surface area for throwing the ball thereat. In alternative embodiments, the substrate may be a square, triangular, spherical, cylindrical, or polygonal. In an example, the non-rebound substrate 200 has a length (as represented by 'L' in FIG. 3) and a height (as represented by 'H' in FIG. 3) of from 100 cm to 500 cm, preferably 150 cm to 450 cm, preferably 200 cm to 400 cm, preferably 250 cm to 350 cm, or 300 cm. In a particular example, the non-rebound substrate 200 may have a square shape with dimensions of 120 cm by 120 cm. In alternative embodiments, the substrate is a square shape with dimensions of 100 cm by 100 cm, preferably 200 cm by 200 cm, preferably 400 cm by 400 cm, preferably 600 cm by 600 cm, preferably 800 cm by 800 cm, or 1000 cm by 1000 cm. Such dimensions may be selected as these results in the non-rebound substrate 110 with suitable size to be installed in most sports training settings, such as against typical walls in gyms, courts (like tennis courts), and the like.

Again, referring to FIGS. 2-5 in combination, the non-rebound substrate 110 includes a first frame 210. In the present embodiments, the first frame 210 is substantially rectangular and is continuous around a circumferential edge of the non-rebound substrate 110. In alternative embodiments, the first frame may be a square, triangular, spherical, cylindrical, or polygonal. In particular, the first frame 210 may conform to the shape of the non-rebound substrate 200 (as described above). As shown, the first frame 210 is disposed around a peripheral edge of the non-rebound substrate 200. For this purpose, the first frame 210 may have substantially equal inner dimensions (length and height thereof, not shown in associated figures) as the dimensions (the length 'L' and the height 'H') of the non-rebound substrate 200. In particular, the first frame 210 includes a plurality of supports. Herein, each support of the plurality of supports defines an edge of the first frame 210, such that when the plurality of supports are joined together forms the first frame 210. Specifically, for achieving the rectangular shape, the plurality of supports includes two vertical supports (as represented by reference numeral 212) and two horizontal supports (as represented by reference numeral 214), with the two vertical supports 212 being disposed opposite to each other and the two horizontal supports 214 being arranged therebetween. In certain embodiments, the number of vertical and horizontal supports may be 3, preferably 4, preferably 5, preferably 7, or 10. Further, in one or more embodiments, the two vertical supports 212 has a thickness '$t_1$' of from 20 mm to 40 mm, preferably 22 mm to 38 mm, preferably 24 mm to 36 mm, preferably 26 mm to 34 mm, preferably 28 mm to 32 mm, or 30 mm, and the two horizontal supports 214 had a thickness '$t_2$' of from 10 mm to 30 mm, preferably 12 mm to 28 mm, preferably 14 mm to 26 mm, preferably 16 mm to 24 mm, preferably 18 mm to 22 mm, or 20 mm. In an example embodiment, a width of the first frame 210 is about 20 mm and a height of the first frame 210 is about 30 mm. In alternative embodiments, the width of the first frame is 30 mm, preferably 40 mm, preferably 60 mm, preferably 80 mm, preferably 100 mm, or 200 mm. In alternative embodiments, the first frame has a height of 40 mm, preferably 60 mm, preferably 80 mm, preferably 100 mm, preferably 200 mm, or 300 mm. Furthermore, in the present embodiments, the first frame 210 is made of wood. In alternative embodiments, the first frame is made of plastic, rubber, bamboo, cork, metal, foam, concrete, or a combination of the like. That is, herein, the vertical supports 212 are made of wood, and the horizontal supports 214 are made of wood. In alternative embodiments, the vertical and horizontal supports are made of plastic, rubber, bamboo, cork, metal, foam, concrete, or a combination of the like. In the present examples, the wooden composition allows the first frame 210, including the two vertical supports 212 and the two horizontal supports 214, to be fixed to the non-rebound substrate 200 along edges thereof by using fasteners, such as nails.

Referring back to FIG. 1, as shown, the system 100 further includes an array of sensors (as generally represented by reference numeral 120). Referring again to FIGS. 2-5 in combination, as shown, the array of sensors 120 is disposed in a center portion of the first frame 210. As may be seen, the center portion of the first frame 210, in general, coincides with a center portion of the non-rebound substrate 200. In certain embodiments, the array of sensors may be placed in the corners of the frame or elsewhere in the frame for specific ball sports. Herein, specifically, the array of sensors 120 is installed/mounted on the said center portion of the non-rebound substrate 200. This is done so as to, otherwise, avoid damping effect by the non-rebound substrate 200. In an example, the non-rebound substrate 200 may have slots (not shown) formed in the center portion thereof, with each such slot generally of same size as given size of each sensor of the array of sensors 120 and arranged in a pattern corresponding to pattern of the array of sensors 120; and each sensor of the array of sensors 120 being mounted in one of such slots. In certain embodiments, the slots may be of a triangular shape, a square shape, a rectangular shape, or a polygonal shape.

In an embodiment, the array of sensors 120 includes at least 9 sensors configured in rows in a rectangular array in the central portion of the first frame 210 (specifically, the non-rebound substrate 200), preferably at least 10, preferably at least 15, preferably at least 20, preferably at least 25, or 30. As shown, the sensors in the array of sensors 120 may be arranged in three rows and three columns to define the given rectangular array. In alternate embodiments, the array of sensors 120 may be arranged in four rows and four columns to define the given rectangular array, or five rows and five columns. Such rectangular pattern for the array of sensors 120 may be beneficial to cover a large area in the center portion of the non-rebound substrate 200, and thereby provide a large area for the athlete to hit the ball during training using the system 100 of the present disclosure. In alternative embodiments, the array of sensors can be arranged in 4 columns and 4 rows, preferably 6 columns and 6 rows, preferably 8 columns and 8 rows, or 10 columns and 10 rows. In alternative embodiments, the array may spherical, triangular, polygonal, star-shaped, or the like. It may be appreciated that the given rectangular pattern for the array of sensors 120 defines a center sensor (as represented by reference numeral 122) of the array of sensors 120, with other sensors (as represented by reference numeral 124) surrounding the said center sensor 122. Herein, the center sensor 122 should be an aim point for the user to hit the ball. In alternative embodiments, there may be multiple center sensors to aim for dependent upon the geometry of the array. In some examples, the center sensor 122 may be highlighted by color coding or the like for the benefit of the user to identify the aim point easily.

Figure 4:
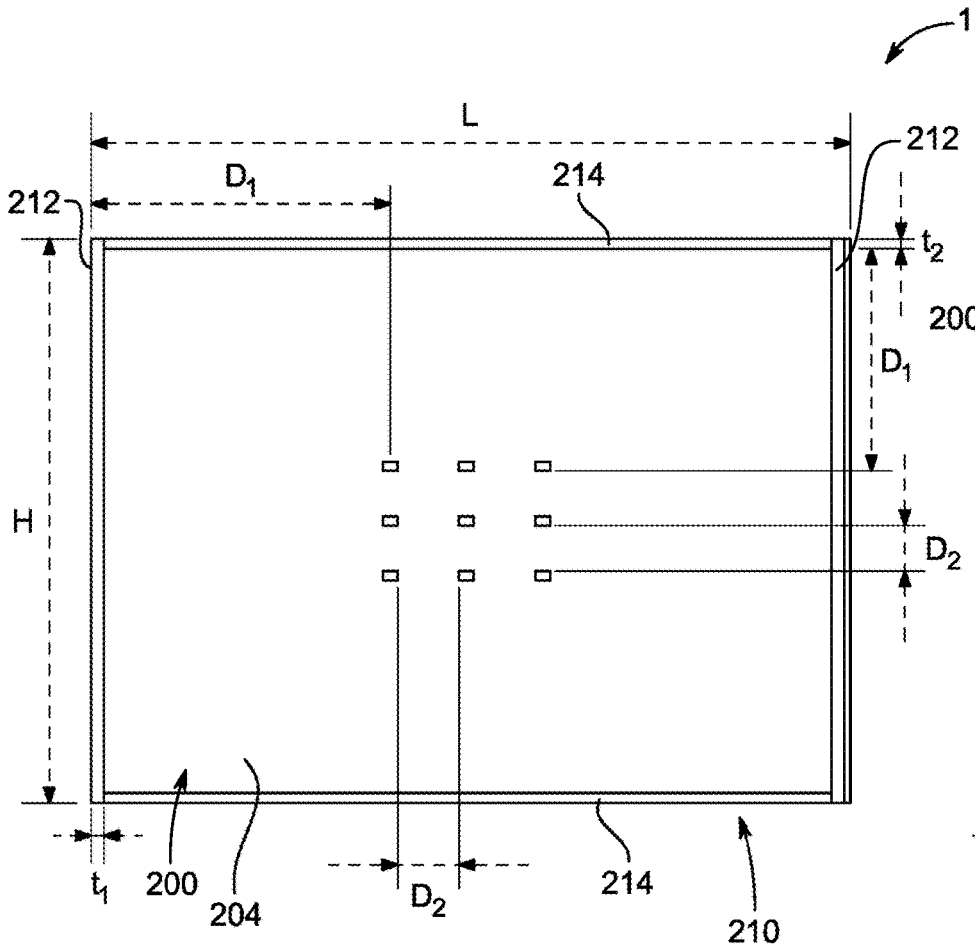
FIG. 4 is a front planar view illustration of the non-rebound substrate of the athlete performance feedback system, according to certain embodiments.
Figure 5:
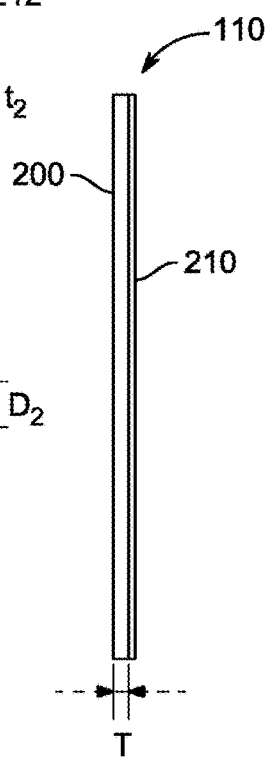
FIG. 5 is a side planar view illustration of the non-rebound substrate of the athlete performance feedback system, according to certain embodiments.

Further, as shown in FIG. 4, the sensors located at outer boundary in the array of sensors 120 are located at a distance from each edge of the first frame 210. In one or more examples, a distance '$D_1$' from each edge (including the vertical supports 212 and the horizontal supports 214) of the first frame 210 is at least 50 cm, preferably at least 60 cm, preferably at least 70 cm, preferably at least 80 cm, preferably at least 90 cm, or at least 100 cm. That is, the sensors in the array of sensors 120 are at least 50 cm away from each edge of the first frame 210. Further, as shown, the sensors in the array of sensors 120 are spaced apart from each other in the center portion of the first frame 210. In one or more examples, a gap '$D_2$' between the sensors in the array of sensors 120 is at most 10 cm apart from each other, preferably at least 20 cm, preferably at least 30 cm preferably at least 40 cm, or at least 50 cm. Such arrangement of the array of sensors 120 in the non-rebound substrate 200 provides suitable placement of sensors therein for proper sensing of impact due to hitting of the ball at the non-rebound substrate 200. Specifically, the distances '$D_1$' provide suitable placement of the array of sensors 120 where likelihood of impact of the ball at the non-rebound substrate 200 is high. Further, the gaps '$D_2$' between the sensors in the array of sensors 120 provide sufficient coverage by the array of sensors 120 to likely detect instances of the impact of the ball at the non-rebound substrate 200.

Figure 6:
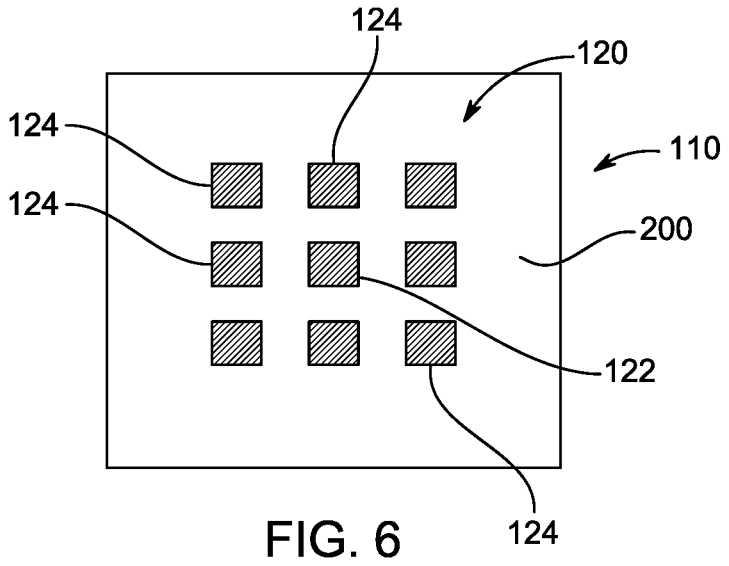
FIG. 6 is a schematic illustration of an array of sensors for the athlete performance feedback system, according to certain embodiments.

In one or more embodiments of the present disclosure, the array of sensors 120 are accelerometers. FIG. 6 illustrates an embodiment of the array of sensors 120 in which the sensors 122 and 124 are accelerometers. As known in the state of art, the accelerometers are electronic sensors that measure the acceleration forces acting on an object, in order to determine the object's position in space and monitor the object's movement. Herein, acceleration, which is a vector quantity, is the rate of change of an object's velocity (velocity being the displacement of the object divided by the change in time). The accelerometers are particularly useful to sense dynamic forces, which are "moving" forces applied to the object at various rates, as required for purposes of the present disclosure to measure impact of hitting ball thereat or in vicinity thereof. In certain embodiments, the accelerometers can measure impacts at velocities of up to 10 miles per hour (mph), preferably 20 mph, preferably 40 mph, preferably 60 mph, preferably 80 mph, or 100 mph. Further, the accelerometers may be suitable to be employed in the present system because of their compact size and affordability.

In an embodiment, each sensor (i.e., the sensors 122, 124) of the array of sensors 120 is a piezo resistance accelerometer. As known in the art, the piezo resistance accelerometer increases its resistance in proportion to the amount of pressure applied to it. Thereby, for purposes of the present disclosure, when the ball may hit the non-rebound substrate 110, the resultant pressure imparted on the sensors 122, 124, being the piezo resistance accelerometers, may generate a corresponding resistance output, which in turn may be used to measure impact of the hitting ball. In another embodiment, each sensor (i.e., the sensors 122, 124) of the array of sensors 120 is a capacitive accelerometer. In certain embodiments, the piezo resistance accelerometers may accommodate a pressure of up to 10 psi, preferably 20 psi, preferably 40 psi, preferably 60 psi, preferably 80 psi, or 100 psi. In certain embodiments, the piezo resistance accelerometers can measure impacts at velocities of up to 10 mph, preferably 20 mph, preferably 40 mph, preferably 60 mph, preferably 80 mph, or 100 mph. As known in the art, the capacitive accelerometer use change in electrical capacitance to determine an object's acceleration. Specifically, when the capacitive accelerometer undergoes acceleration, the distance between its capacitor plates changes as diaphragm of the capacitive accelerometer moves. Thereby, for purposes of the present disclosure, when the ball may hit the non-rebound substrate 110, the resultant change in the electrical capacitance in the sensors 122, 124, being the capacitive accelerometers, may be used to generate a corresponding measurement indicative of the impact of the hitting ball. In still other embodiments, each sensor (i.e., the sensors 122, 124) of the array of sensors 120 is a piezo electric accelerometer. As known in the art, the piezo electric accelerometer utilizes the piezoelectric effect (as piezoelectric materials produce electricity when put under physical stress) to sense change in acceleration. In certain embodiments, the piezo electric accelerometers can measure impacts at velocities of up to 10 mph, preferably 20 mph, preferably 40 mph, preferably 60 mph, preferably 80 mph, or 100 mph. Thereby, for purposes of the present disclosure, when the ball may hit the non-rebound substrate 110, the resultant electricity produced by the sensors 122, 124, being the piezo electric accelerometers, may be used to generate a corresponding measurement indicative of the impact of the hitting ball. In the present system 100, the preferred type of accelerometer may be the piezo electric accelerometer since such sensor directly measures the impact of the ball by producing electricity from the piezoelectric material, and thereby piezoelectric effect may be utilized to sense the change in the acceleration.

In other embodiments, each sensor (i.e., the sensors 122, 124) of the array of sensors 120 is a force resistor sensor. As known in the art, the force resistor sensor uses the electrical property of resistance to measure the force (or pressure) applied thereto. Generally, the force resistor sensor is made up of two parts, a resistive material applied to a film and a set of contacts applied to another film. In certain embodiments, the force resistor sensor may accommodate a pressure of up to 10 psi, preferably 20 psi, preferably 40 psi, preferably 60 psi, preferably 80 psi, or 100 psi. In certain embodiments, the force resistance sensor can measure impacts at velocities of up to 10 mph, preferably 20 mph, preferably 40 mph, preferably 60 mph, preferably 80 mph, or 100 mph. Herein, the resistive material serves to make an electrical path between the two sets of conductors on the other film. Thereby, for purposes of the present disclosure, when a force is applied to the force resistor sensor, a proper connection is made between the contacts, hence the conductivity is increased (approximately a linear function of force), which in turn may be used to generate a corresponding measurement indicative of the impact of the hitting ball thereat or in vicinity thereof.

Figure 7:
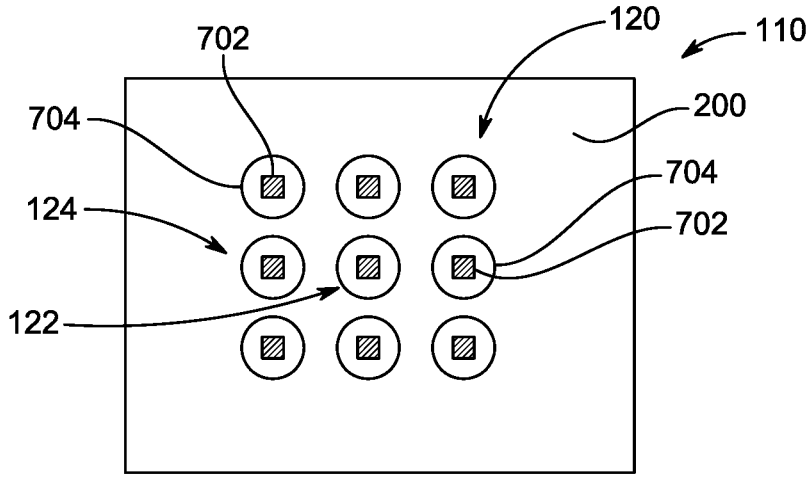
FIG. 7 is a schematic illustration of an array of sensors for the athlete performance feedback system, according to an alternate embodiment.

In yet another embodiment, each sensor of the array of sensors 120 includes a spring-laser arrangement. FIG. 7 illustrates an embodiment of the array of sensors 120 in which each sensor 122, 124 includes a laser 702 with a spring 704 associated therewith. For implementing this design, the non-rebound surface 200 of the non-rebound substrate 110 may be provided with multiple springs 704 (e.g., coil springs) arranged in the given pattern of the array of sensors 120, and with the lasers 702 arranged within circumference of the corresponding springs 704 (in other words, the springs 704 surrounding the corresponding laser 702). In certain embodiments, the laser 702 and spring 704 may be placed at each corner of the surface 200 or elsewhere within the surface itself. In certain embodiments, the laser 702 may have a power of 1 MW, preferably 10 MW, preferably 20 MW, preferably 40 MW, preferably 60 MW, preferably 80 MW, or 100 MW. In certain embodiments, the spring-laser arrangement can measure impacts at velocities of up to 10 mph, preferably 20 mph, preferably 40 mph, preferably 60 mph, preferably 80 mph, or 100 mph. Thereby, for purposes of the present disclosure, when the impact is made, one or more springs 704 compress, and the compression is measured by the corresponding lasers 702. Specifically, the present design uses the concept of stiffness of the spring 704 and distance change, as may be detected the laser 702. Herein, the measured force is given by $F=K*x$, where 'K' represents the stiffness of the spring and x represents the change in distance (displacement).

Figure 8:
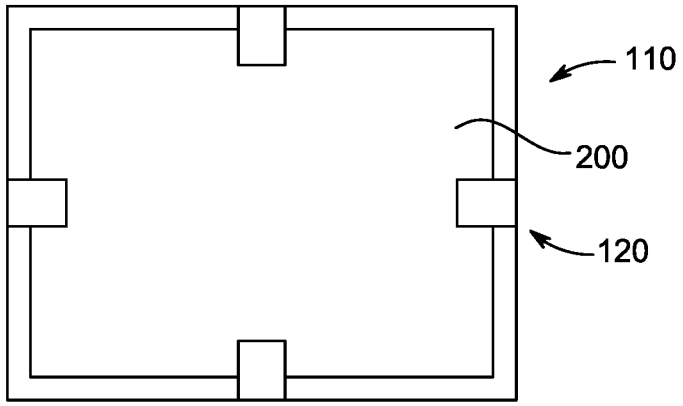
FIG. 8 is a schematic illustration of an array of sensors for the athlete performance feedback system, according to another alternate embodiment.

In still another embodiment, each sensor of the array of sensors 120 is a load cell. FIG. 8 illustrates an embodiment of the array of sensors 120 in which the sensors are load cells. As known in the art, a load cell is a force transducer that converts the force to an electrical signal, which can be measured. The compression force is one of the forces that can be converted by the load cells. In certain embodiments, the load cells can measure impacts at velocities of up to 10 mph, preferably 20 mph, preferably 40 mph, preferably 60 mph, preferably 80 mph, or 100 mph. Thereby, for purposes of the present disclosure, when the impact is made, the compression of the non-rebound surface 200 of non-rebound substrate 110 (or directly of the load cell as located on edges thereof) is measured, which in turn may be used to generate a corresponding measurement indicative of the impact of the hitting ball. Since the present application has a high frequency (i.e., multiple hits per minute), the load cells may be a suitable choice for the array of sensors 120 as these work with high efficiency and high accuracy under such conditions. In certain embodiments, the load cells can accommodate frequencies of 5 hits per minute, preferably 10 hits per minute, or 20 hits per minute. As the average applied force may be about 20 kN (e.g., force of tennis ball hit), the suitable type of load cell may be a Pancake load cell (as known in the art and thus not described herein), whose capacity varies from 22 kN to 446 kN (but it is recommended to stay under 111 kN) and is applicable for high-frequency applications. In certain embodiments, the load cell can handle forces from 100 kN to 10 MN, preferably 300 kN to 8 MN, preferably 500 kN to 6 MN, preferably 700 KN to 4 MN preferably 1 MN to 3 MN, or 2 MN.

Each of the above given examples for the sensors in the array of sensors 120 satisfies the purposes of the present disclosure, which is calculating the impact force caused by hitting of the ball at the non-rebound substrate 200. In the present examples, the sensors in the array of sensors 120 may operate with a frequency of about 100 Hz (±5 Hz) to robustly provide signals for calculating the impact force, preferably 200 Hz, preferably 400 Hz, preferably 600 Hz, preferably 800 Hz, or 1000 Hz. It may be appreciated that by knowing a weight of the thrown ball (e.g., tennis ball), all parameters of interest, including the force of a ball impact from the user, the impact point of the ball impact, and the distance of the ball impact with respect to the center sensor 122, can be calculated. In certain embodiments, the sensors 122 can accommodate ball weights up to 0.5 pounds, preferably 1 pound, preferably 2 pounds, or 5 pounds. It may be appreciated by a person skilled in the art that different types of sensors may provide different types of outputs and thus there may be a need for an interface to standardize the same for performing useful calculations as per embodiments of the present disclosure.

Referring back to FIG. 1, in the present embodiments, the system 100 includes a digital sensor interface 130 for collecting and converting output of the array of sensors 120 for performing the said calculation. As shown, the digital sensor interface 130 is connected to each of the sensors in the array of sensors 120. In the present examples, such connections may be made by using wires. In certain embodiments, the wires may be fabricated from copper, aluminum, stainless steel, or alloys of the like. The digital sensor interface 130 is configured to read out information from the input signal generated by complex sensors, providing a suitable output signal that may be utilized by a host system to display or process. For this purpose, the digital sensor interface 130 may utilize signal converters with multiple signal channels, and which may be dynamically programmed in-process by means of multiple amplification levels. The output of the digital sensor interface 130 is usually in the form of a change in voltage (mV/V), frequency, or current. In one or more embodiments of the present disclosure, the digital sensor interface 130 includes a USB or UART. In alternative embodiments, the digital sensor interface 130 includes Wi-Fi or Bluetooth. Such interfaces are well known and widely used in the art, and thus have not been described herein for the brevity of the present disclosure.

Further, as illustrated in FIG. 1, the system 100 includes a control unit 140. Herein, the control unit 140 is responsible for performing the said calculations. As shown, the control unit 140 includes a processor 142 and the processor 142 is electrically connected to the digital sensor interface 130. In the present embodiments, the processor 142 is configured with instructions to calculate acceleration, force, time, or impulse of the ball impact. In general, when the impact takes place, the resultant vibration may be sensed by the array of sensors 120 to provide analog signals, like a sine wave with peaks representing impacts and distance between peaks representing time between impacts. The digital sensor interface 130 may convert such signals into useable output values representative of acceleration/force. It may be understood that additional force to the known mass of the ball is utilized to determine the impact force. Herein, the impact point may be determined based on which of the sensors of the array of sensors 120 may provide the signal with the most significant peak at a particular instance. The processor 142 in the control unit 140 may use these values and is configured with instructions to calculate the force, the impact point, and the distance from the user to the system 100 (specifically the non-rebound substrate 200) based on the data received from the array of sensors 120.

In an example embodiment of the present disclosure, the control unit 140 is an Arduino unit (such as, Arduino Mega 2560). The Arduino unit consists of a physical programmable circuit board (often referred to as a microcontroller) and a piece of software, or IDE (Integrated Development Environment) that runs on a computer, to write and upload computer code to the physical non-rebound substrate. Herein, the Arduino unit provides a framework which can run on the embedded controller. The Arduino unit may implement Linux, MacOS, or FreeBSD environments. The Arduino unit may be suitable as the control unit 140 for its simplicity, compactness, and affordability. Herein, the Arduino unit because of its compactness and low power requirements may allow it to be mounted on the non-rebound substrate 200, making the present system 100 self-sufficient (with battery power) and portable.

Further, in order to enable the user (athlete) to observe his/her performance and to further provide performance analysis, the system 100 includes a wireless transmission unit 150 electrically connected to the control unit 140 and configured to send data based on the ball impact to the user through a handheld electronic device 160. That is, the calculated values from the control unit 140 are transmitted to the handheld electronic device 160 (such as, a smartphone, a tablet, a laptop, etc.). In the present examples, the wireless transmission unit 150 may be in the form of a Wi-Fi controller, a wireless router, or Bluetooth units which may connect to the handheld electronic device 160 via a local wireless network or Internet for transmission of the said date data related to the ball impact. Herein, a user interface provided by the handheld electronic device 160 may transform the received data to a readable chart that simulates the athlete's performance, and may be used to analyze the performance and provide development feedback. In an example, the said chart may be in the form of a sinusoidal graph (force vs time), in which higher the dome, stronger the ball impact, and the like. Such implementation may be contemplated by a person of ordinary skill in the art and thus has not been described herein.

Figure 9:
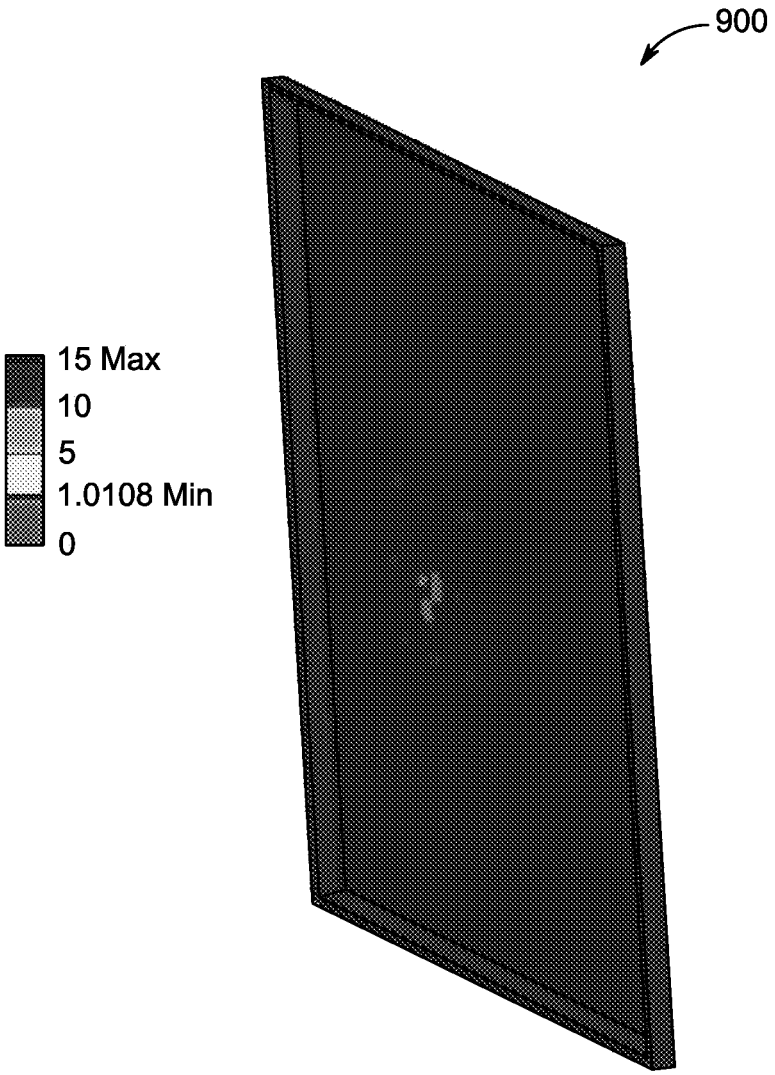
FIG. 9 is a finite element modelling output for a safety factor of the non-rebound substrate of the athlete performance feedback system, according to certain embodiments.
Figure 10:
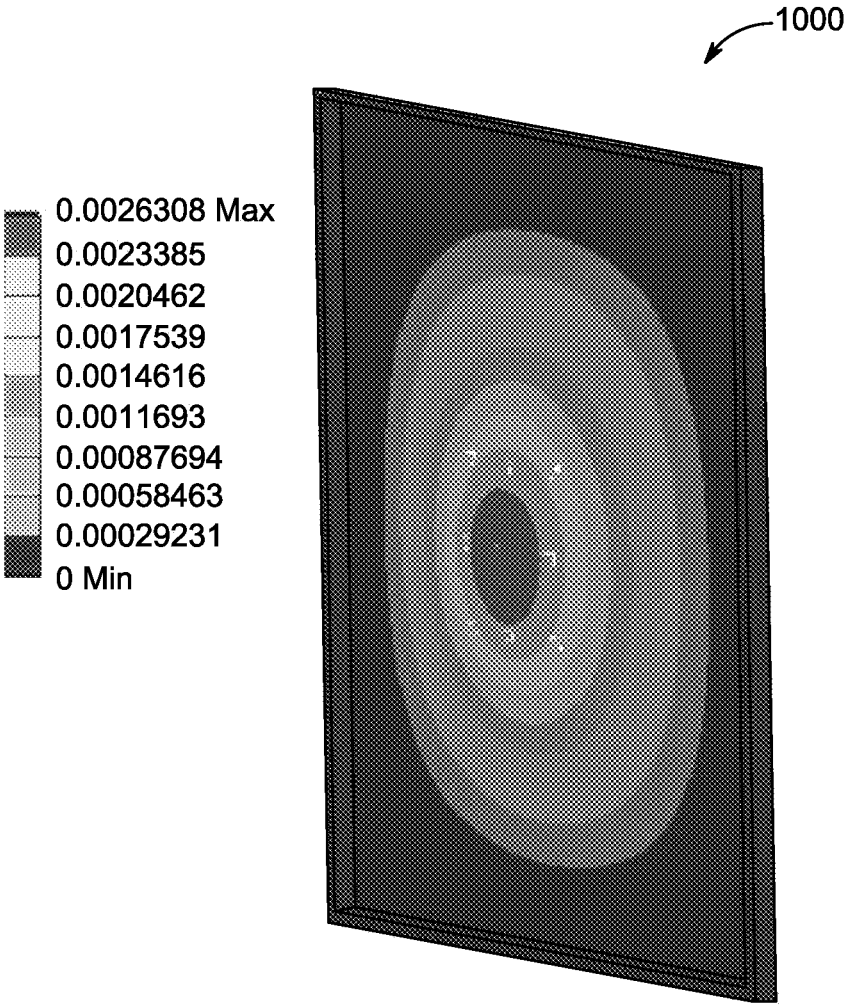
FIG. 10 is a finite element modelling output for a total deformation of the non-rebound substrate of the athlete performance feedback system, according to certain embodiments.

Referring now to FIG. 9, illustrated is a finite element modelling output (represented by reference numeral 900) for a safety factor of the non-rebound substrate 110 of the athlete performance feedback system 100. Herein, the safety factor defines a ratio between a strength of the non-rebound substrate 110 and a maximum stress in a portion thereof, to indicate specific area of non-rebound substrate 110 where the stress may be higher than the strength the material of the non-rebound substrate 110 can bear. As may be seen from the finite element modelling output 900 of FIG. 9, the safety factor of the non-rebound substrate 110 is sufficiently high closer to edges (i.e., the first frame 210) and is still sufficient near the center portion thereof (where it is lowest while still above the minimum required). Referring also to FIG. 10, illustrated is a finite element modelling output (represented by reference numeral 1000) for a total deformation of the non-rebound substrate 110 of the athlete performance feedback system 100. Herein, the total deformation may be used to obtain displacements from stresses and gives a square root of the summation of the square of deformation in x-direction, y-direction and z-direction, to indicate portions (areas) of the non-rebound substrate 110 prone to possible failure due to large deformation. As may be seen from the finite element modelling output 1000 of FIG. 10, the total deformation of the non-rebound substrate 110 is sufficiently low closer to edges (i.e., the first frame 210) and maximum values near the center portion thereof may still be within an acceptable range to avoid failure of the non-rebound substrate 110. The given analyses from the finite element modelling outputs 900 and 1000 ensures that the non-rebound substrate 110 of the present system 100 may be able to withstand forces due to impact of the ball, with a possible constraint being the mass of the ball should not be exceedingly large (within 20 to 40 grams), such as metal balls or the like. In general, the system 100 of the present disclosure may be best suited for providing performance feedback for ball impacts from tennis balls and the like.

Figure 11:
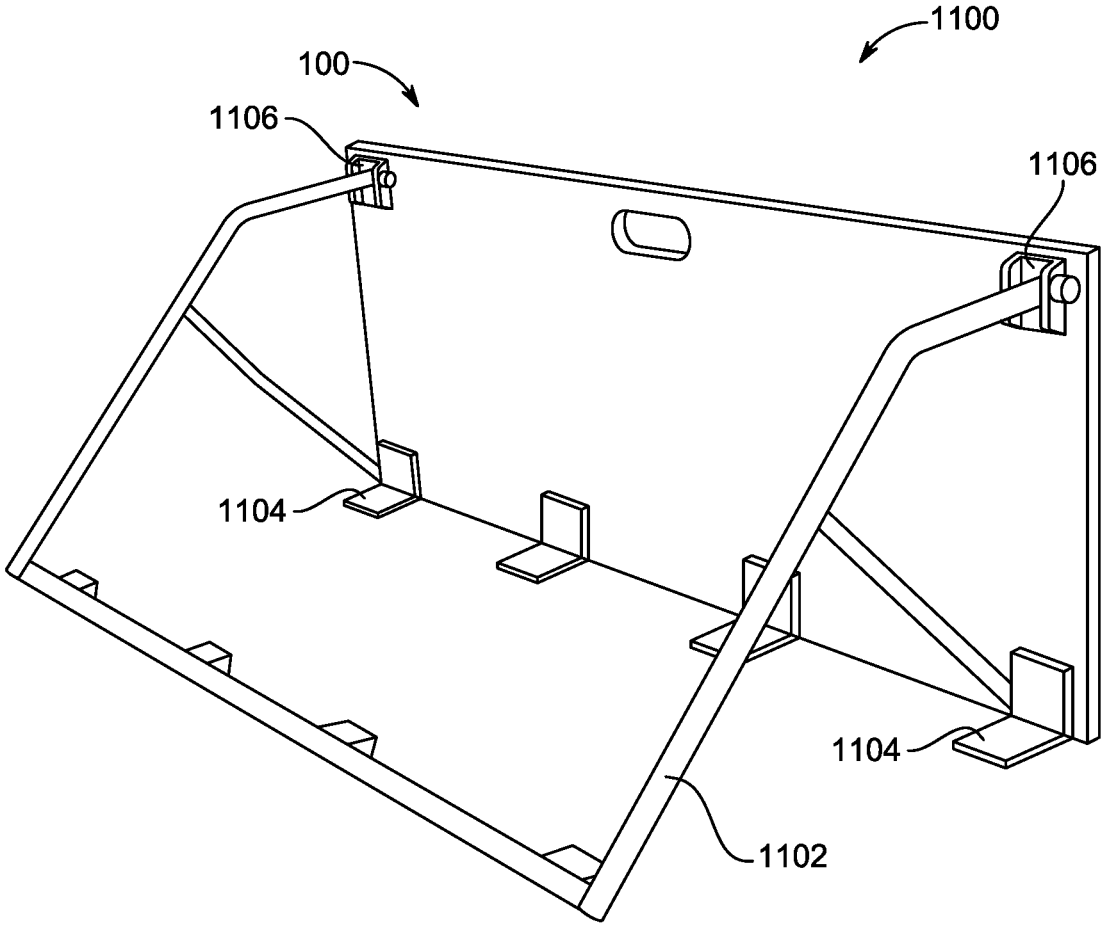
FIG. 11 is a diagrammatic illustration of a training device implementing the athlete performance feedback system, according to certain embodiments.

Referring to FIG. 11, illustrated is a diagrammatic illustration of a training device (represented by reference numeral 1100) implementing the athlete performance feedback system 100 of the present disclosure. As shown, the training device 1100 utilizes the athlete performance feedback system 100 in the form of a feedback panel (with the two terms being interchangeably used hereinafter), defining a front facing surface of the training device 1100. In the training device 1100, the athlete performance feedback system 100 is supported by a supporting frame 1102. The supporting frame 1102 may help to keep the feedback panel 100 stay upright or at a desired angle with respect to the ground. In certain embodiments, the supporting frame 1102 may be constructed of plastics (PVC, PE, PP, PETE, PET, or the like), metal, nylon, resins, or alloys. In certain embodiments, the diameter of the supporting frame tube may be 5 cm, preferably 10 cm, preferably 20 cm, preferably 35 cm, or 50 cm. For this purpose, the supporting frame 1102 may be fixedly connected to a back of the feedback panel 100 using one or more fixed brackets 1104 located along bottom edge and/or bottom corners at the back of the feedback panel 100. In certain embodiments, the brackets 1104 are metal or plastic and can fixedly attach tubes of the supporting frame 1102 to the system 100 through screws, bolts, or washers. Further, the supporting frame 1102 may be pivotally connected to the back of the feedback panel 100 using one or more pivot brackets 1106 (as known in the art) to allow for changing an angle of inclination of the feedback panel 100 with respect to the ground, as may be required in some training instances. In certain embodiments, the brackets 1106 are made of metal, metal alloys, resins, or plastic. In certain embodiments, the brackets 1106 can accommodate tubes of the frame 1102 with a diameter of 5 cm, preferably 10 cm, preferably 20 cm, preferably 35 cm, or 50 cm.

The system 100 of the present disclosure may be utilized to provide performance feedback by measuring the force of the ball hitting the non-rebound substrate 200 therein, and further provide information about stamina of the user by using the time interval between the hits (to determine time interval for which the athlete can sustain the same force). In certain embodiments, the system 100 can accommodate time intervals of 120 seconds between hits, preferably 60 seconds between hits, preferably 30 seconds per hits, preferably 15 seconds between hits, or 10 seconds between hits. Such methodology may be understood by a person skilled in the art and thus not explained in detail herein. With sufficient data, the system 100 may be able to compare past performance(s) of the user and provide parameters that could identify improvement of stamina of the athlete. In some examples, the captured performance data may be stored in a central server to generate reports for performance comparisons between different users (like a gaming competition). The system 100 of the present disclosure when implemented, for example, as the training device 1100 is generally self-sufficient and portable (for instance, when implemented with a battery to drive the digital sensor interface 130, the control unit 140 and the wireless transmission unit 150), and may be further used in outdoor settings as it being primarily made of wooden material be capable to withstand temperature of up to 50° C., preferably up to 55° C., or up to 60° C. It may be noted that the present system 100 may preferably be installed against a rigid wall to provide support thereto from impacts of the ball and for more accurate results.

The present system 100 may be used to measure performance of athletes for different types of ball sports, such as football, tennis, and even for patients using medicine ball. The system 100 may be useful tool for sports clubs, fitness centers and athletes which involve sport or training using explosive strength in upper or lower limbs. The system 100 may also be useful tool for physiotherapists to recognize if a patient has fully recovered from injury or identify at which stage of recovery the patient may be right now. It may be appreciated that the feedback from the present system 100 could be used as an objective factor during patient recovery. The system 100 may further be used as a toy or physical game for people who may like to get feedback about their performance, which can be compared for competing with others. The present system 100 may also be a good motivational and enjoyable tool.

Figure 12:
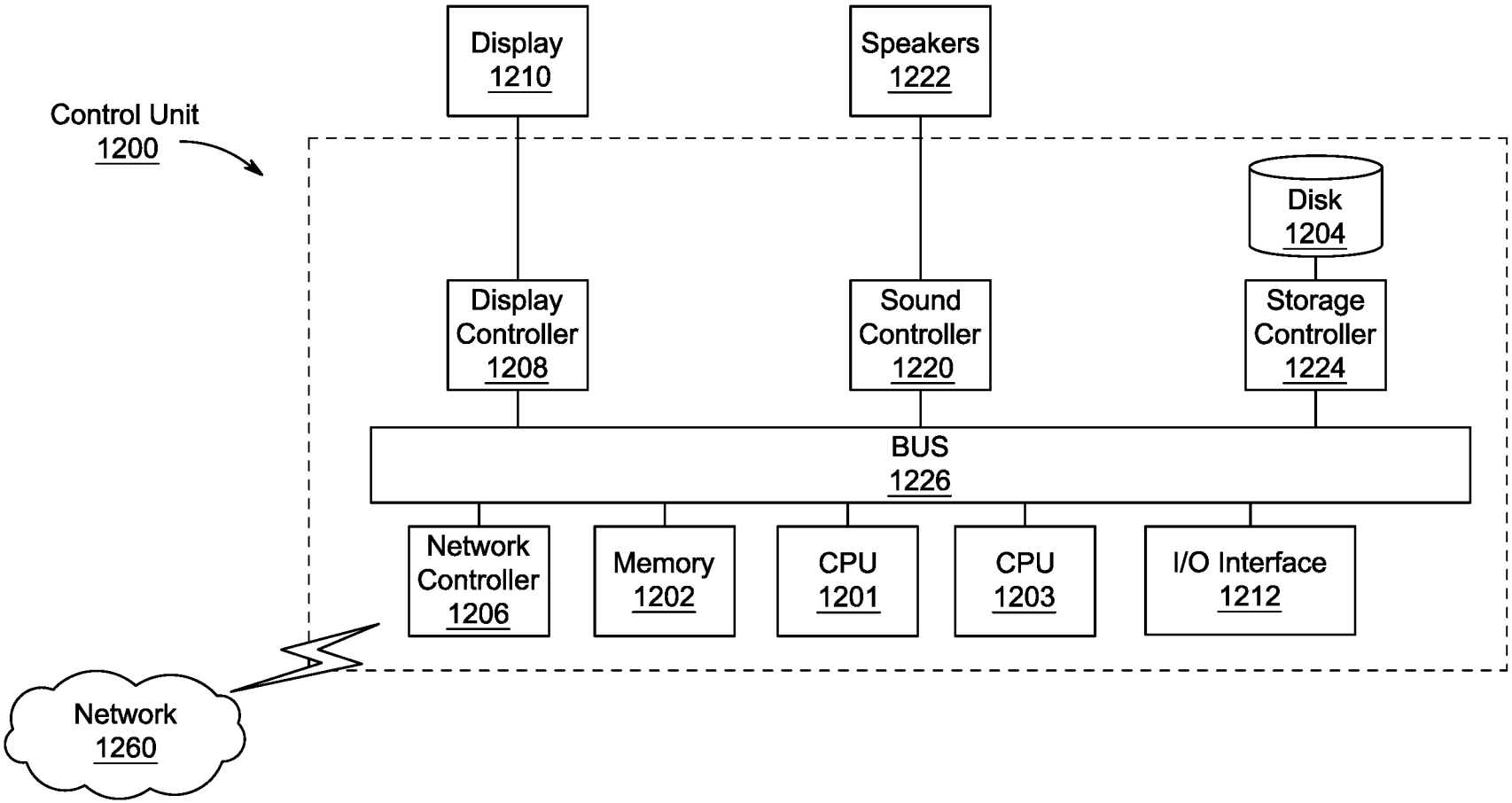
FIG. 12 is an illustration of a non-limiting example of details of computing hardware used in the computing system, according to certain embodiments.

Further details of hardware description for the present system 100 according to exemplary embodiments is described with reference to FIG. 12. In FIG. 12, a control unit 1200 is described which is representative of the computing environment (or specifically the control unit 140) of the present system 100, in which the control unit 1200 includes a CPU 1201 which performs the processes described above/below. The process data and instructions may be stored in memory 1202. These processes and instructions may also be stored on a storage medium disk 1204 such as a hard drive (HDD) or portable storage medium or may be stored remotely.

Further, the claims are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the computing device communicates, such as a server or computer.

Further, the claims may be provided as a utility application, background daemon, or component of an operating system, or combination thereof, executing in conjunction with CPU 1201, 1203 and an operating system such as Microsoft Windows 7, Microsoft Windows 10, UNIX, Solaris, LINUX, Apple MAC-OS and other systems known to those skilled in the art.

The hardware elements in order to achieve the computing device may be realized by various circuitry elements, known to those skilled in the art. For example, CPU 1201 or CPU 1203 may be a Xenon or Core processor from Intel of America or an Opteron processor from AMD of America, or may be other processor types that would be recognized by one of ordinary skill in the art. Alternatively, the CPU 1201, 1203 may be implemented on an FPGA, ASIC, PLD or using discrete logic circuits, as one of ordinary skill in the art would recognize. Further, CPU 1201, 1203 may be implemented as multiple processors cooperatively working in parallel to perform the instructions of the inventive processes described above.

The computing device in FIG. 12 also includes a network controller 1206, such as an Intel Ethernet PRO network interface card from Intel Corporation of America, for interfacing with network 1260. As can be appreciated, the network 1260 can be a public network, such as the Internet, or a private network such as an LAN or WAN network, or any combination thereof and can also include PSTN or ISDN sub-networks. The network 1260 can also be wired, such as an Ethernet network, or can be wireless such as a cellular network including EDGE, 3G and 4G wireless cellular systems. The wireless network can also be WiFi, Bluetooth, or any other wireless form of communication that is known.

The computing device further includes a display controller 1208, such as a NVIDIA GeForce GTX or Quadro graphics adaptor from NVIDIA Corporation of America for interfacing with display 1210, such as a Hewlett Packard HPL2445w LCD monitor. A general purpose I/O interface 1212 may also be provided.

A sound controller 1220 is also provided in the computing device such as Sound Blaster X-Fi Titanium from Creative, to interface with speakers/microphone 1222 thereby providing sounds and/or music.

The general purpose storage controller 1224 connects the storage medium disk 1204 with communication bus 1226, which may be an ISA, EISA, VESA, PCI, or similar, for interconnecting all of the components of the computing device. A description of the general features and functionality of the display 1210, keyboard and/or mouse (not shown), as well as the display controller 1208, storage controller 1224, network controller 1206, sound controller 1220, and general purpose I/O interface 1212 is omitted herein for brevity as these features are known.

The exemplary circuit elements described in the context of the present disclosure may be replaced with other elements and structured differently than the examples provided herein. Moreover, circuitry configured to perform features described herein may be implemented in multiple circuit units (e.g., chips), or the features may be combined in circuitry on a single chipset, as shown on FIG. 13.

Figure 13:
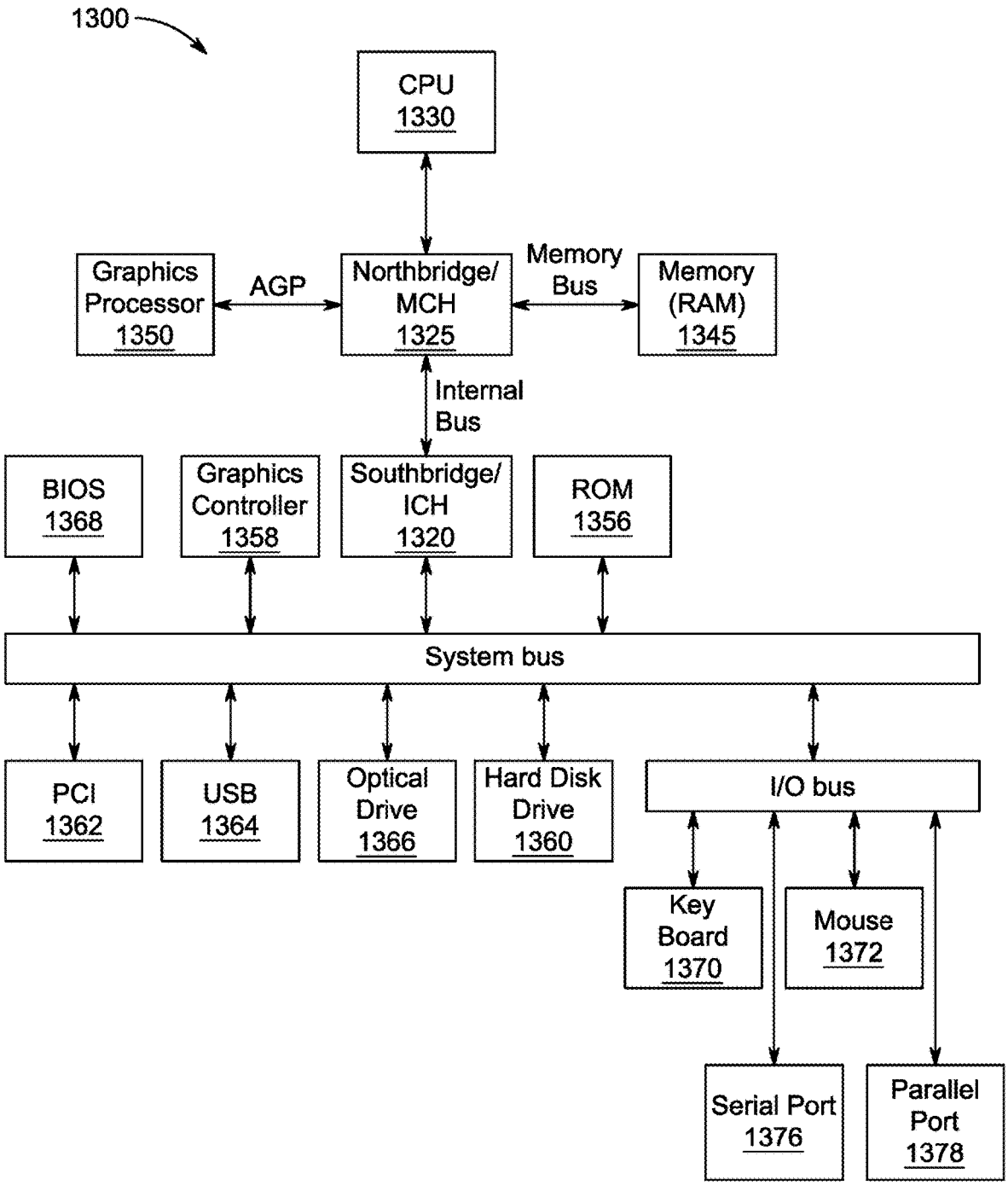
FIG. 13 is an exemplary schematic diagram of a data processing system used within the computing system, according to certain embodiments.

FIG. 13 shows a schematic diagram of a data processing system 1300, according to certain embodiments, for performing the functions of the exemplary embodiments. The data processing system 1300 is an example of a computer in which code or instructions implementing the processes of the illustrative embodiments may be located.

In FIG. 13, the data processing system 1300 employs a hub architecture including a north bridge and memory controller hub (NB/MCH) 1325 and a south bridge and input/output (I/O) controller hub (SB/ICH) 1320. The central processing unit (CPU) 1330 is connected to NB/MCH 1325. The NB/MCH 1325 also connects to the memory 1345 via a memory bus, and connects to the graphics processor 1350 via an accelerated graphics port (AGP). The NB/MCH 1325 also connects to the SB/ICH 1320 via an internal bus (e.g., a unified media interface or a direct media interface). The CPU Processing unit 1330 may contain one or more processors and even may be implemented using one or more heterogeneous processor systems.

Figure 14:
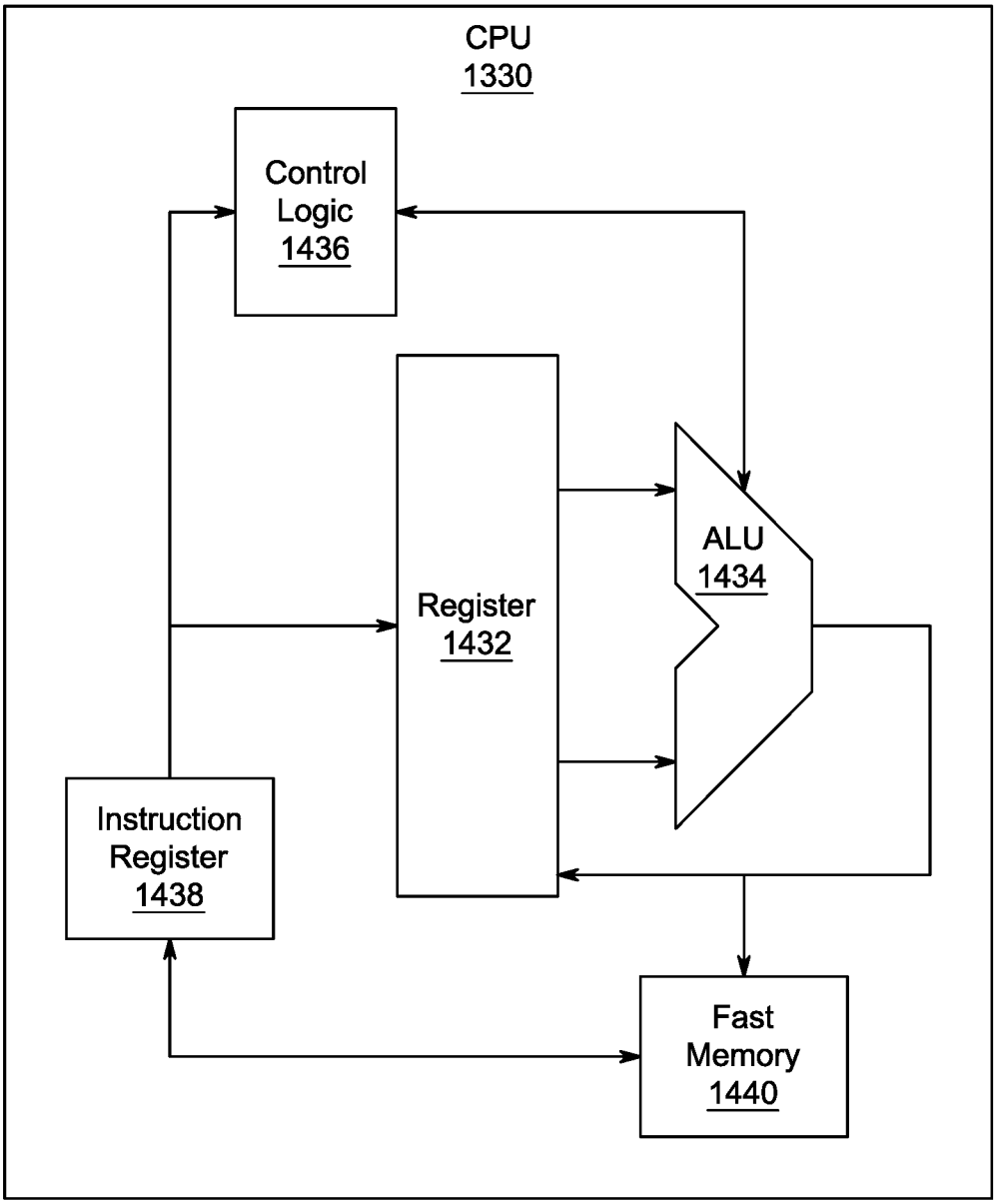
FIG. 14 is an exemplary schematic diagram of a processor used with the computing system, according to certain embodiments.

For example, FIG. 14 shows one implementation of CPU 1330. In one implementation, the instruction register 1438 retrieves instructions from the fast memory 1440. At least part of these instructions are fetched from the instruction register 1438 by the control logic 1436 and interpreted according to the instruction set architecture of the CPU 1330. Part of the instructions can also be directed to the register 1432. In one implementation the instructions are decoded according to a hardwired method, and in another implementation the instructions are decoded according to a microprogram that translates instructions into sets of CPU configuration signals that are applied sequentially over multiple clock pulses. After fetching and decoding the instructions, the instructions are executed using the arithmetic logic unit (ALU) 1434 that loads values from the register 1432 and performs logical and mathematical operations on the loaded values according to the instructions. The results from these operations can be feedback into the register and/or stored in the fast memory 1440. According to certain implementations, the instruction set architecture of the CPU 1330 can use a reduced instruction set architecture, a complex instruction set architecture, a vector processor architecture, a very large instruction word architecture. Furthermore, the CPU 1330 can be standard on the Von Neuman model or the Harvard model. The CPU 1330 can be a digital signal processor, an FPGA, an ASIC, a PLA, a PLD, or a CPLD. Further, the CPU 1330 can be an x86 processor by Intel or by AMD; an ARM processor, a Power architecture processor by, e.g., IBM; a SPARC architecture processor by Sun Microsystems or by Oracle; or other known CPU architecture.

Referring again to FIG. 13, the data processing system 1300 can include that the SB/ICH 1320 is coupled through a system bus to an I/O Bus, a read only memory (ROM) 1356, universal serial bus (USB) port 1364, a flash binary input/output system (BIOS) 1368, and a graphics controller 1358. PCI/PCIe devices can also be coupled to SB/ICH 888 through a PCI bus 1362.

The PCI devices may include, for example, Ethernet adapters, add-in cards, and PC cards for notebook computers. The Hard disk drive 1360 and CD-ROM 1366 can use, for example, an integrated drive electronics (IDE) or serial advanced technology attachment (SATA) interface. In one implementation the I/O bus can include a super I/O (SIO) device.

Further, the hard disk drive (HDD) 1360 and optical drive 1366 can also be coupled to the SB/ICH 1320 through a system bus. In one implementation, a keyboard 1370, a mouse 1372, a parallel port 1378, and a serial port 1376 can be connected to the system bus through the I/O bus. Other peripherals and devices that can be connected to the SB/ICH 1320 using a mass storage controller such as SATA or PATA, an Ethernet port, an ISA bus, a LPC bridge, SMBus, a DMA controller, and an Audio Codec.

Moreover, the present disclosure is not limited to the specific circuit elements described herein, nor is the present disclosure limited to the specific sizing and classification of these elements. For example, the skilled artisan will appreciate that the circuitry described herein may be adapted standard on changes on battery sizing and chemistry, or standard on the requirements of the intended back-up load to be powered.

The functions and features described herein may also be executed by various distributed components of a system. For example, one or more processors may execute these system functions, wherein the processors are distributed across multiple components communicating in a network. The distributed components may include one or more client and server machines, which may share processing, in addition to various human interface and communication devices (e.g., display monitors, smart phones, tablets, personal digital assistants (PDAs)). The network may be a private network, such as a LAN or WAN, or may be a public network, such as the Internet. Input to the system may be received via direct user input and received remotely either in real-time or as a batch process. Additionally, some implementations may be performed on modules or hardware not identical to those described. Accordingly, other implementations are within the scope that may be claimed.

The above-described hardware description is a non-limiting example of corresponding structure for performing the functionality described herein.

Obviously, numerous modifications and variations of the present disclosure are possible in light of the above teachings. It is therefore to be understood that within the scope of the appended claims, the invention may be practiced otherwise than as specifically described herein.

The invention claimed is:

1. An impact board and athletic performance feedback system, comprising:

a non-rebound substrate having a length and a height of from 100 cm to 500 cm and a total thickness of from 25 mm to 30 mm, the non-rebound substrate comprising a wood panel as a back surface and a rubber coating as a front surface, each of the wood panel and the rubber coating having a thickness of about half of the total thickness of the non-rebound substrate;

a first frame disposed around a peripheral edge of the non-rebound substrate;

an array of sensors mounted in the non-rebound substrate;

a digital sensor interface;

a control unit;

a handheld electronic device configured to transform signals received from the control unit to a readable chart; and a wireless transmission unit electrically connected to the control unit and configured to send data based on the ball impact to the handheld electronic device;

wherein the first frame comprises a plurality of supports, wherein a support of the plurality of supports is disposed at each edge of the first frame;

the array of sensors is disposed in a center portion of the first frame;

the plurality of supports includes two vertical supports with a thickness of from 20 mm to 40 mm and two horizontal supports with a thickness of from 10 mm to 30 mm; and the array of sensors are accelerometers, wherein the accelerometers are spaced at most 10 cm apart from each other in the center portion of the first frame and at least 50 cm away from each edge of the first frame;

the control unit comprises a processor and the processor is electrically connected to the digital sensor interface;

the processor is configured with instructions to calculate a force, an impact point, and a distance from a user to the non-rebound substrate based on the data received from the array of sensors;

the array of sensors comprises at least 9 accelerometers configured in rows in a rectangular array in the central portion of the first frame; and a center sensor of the array of sensors is an aim point for the user, wherein the sensors in the array of sensors detect the force of a ball impact from the user, the impact point of the ball impact, and the distance of the ball impact with respect to the center sensor.

2. The system of claim 1, wherein the non-rebound substrate is rectangular.

3. The system of claim 1, wherein the first frame is rectangular and is continuous around a circumferential edge of the non-rebound substrate.

4. The system of claim 1, wherein the control unit is an Arduino unit.

5. The system of claim 1, wherein the digital sensor interface comprises a USB or UART.

6. The system of claim 1, wherein the non-rebound substrate has a Young's modulus of about 25,000 kPa.

7. The system of claim 1, wherein the vertical supports are made of wood.

8. The system of claim 1, wherein the horizontal supports are made of wood.

9. The system of claim 1, wherein the processor is configured with instructions to calculate acceleration, force, time, or impulse of the ball impact.

10. The system of claim 1, wherein each sensor of the array of sensors is a force resistor sensor.

11. The system of claim 1, wherein each sensor of the array of sensors is a piezo resistance accelerometer.

12. The system of claim 1, wherein each sensor of the array of sensors is a capacitive accelerometer.

13. The system of claim 1, wherein the first frame is made of wood.

* * * * *